United States Patent [19]

Wilkins et al.

[11] Patent Number: 4,963,280

[45] Date of Patent: Oct. 16, 1990

[54] METHOD AND COMPOSITION FOR IMPROVING THE ENERGY EFFICIENCY OF HEAT PUMP SYSTEMS

[75] Inventors: Charles H. T. Wilkins, Tuscaloosa, Ala.; Jack Hammack, Hattiesburg, Miss.; Charles B. Thompson, Tusacaloosa, Ala.

[73] Assignees: Charles Henry Tully-Wilkins, Jr., Tuscaloosa, Ala.; Linda Ann Tully-Wilkins Frazier, Irvin, Tex. ; by Thelma Crawford Wilkins, executrix

[21] Appl. No.: 149,737

[22] Filed: Jan. 29, 1988

[51] Int. Cl.[5] ..... C10M 115/06

[52] U.S. Cl. ..... 252/58; 252/68

[58] Field of Search ..... 252/58, 68

[56] References Cited

U.S. PATENT DOCUMENTS

| | | | |
|---|---|---|---|
| 3,972,243 | 8/1976 | Driscoll | 252/58 |
| 4,359,394 | 11/1982 | Gainer | 252/58 |

FOREIGN PATENT DOCUMENTS

| | | | |
|---|---|---|---|
| 0634673 | 3/1950 | United Kingdom | 252/58 |
| 2090859 | 7/1982 | United Kingdom | 252/58 |

*Primary Examiner*—Olik Chaudhuri
*Assistant Examiner*—James M. Hunter, Jr.
*Attorney, Agent, or Firm*—Oblon, Spivak, McClelland, Maier & Neustadt

[57] ABSTRACT

A method of improving the efficiency of a heat pump system comprising introducing into the system a polar compound which is liquid under said systems operating conditions.

10 Claims, No Drawings

METHOD AND COMPOSITION FOR IMPROVING THE ENERGY EFFICIENCY OF HEAT PUMP SYSTEMS

Field of the Invention

The present invention relates to the improvement in the energy efficiency of heat pump systems including refrigeration units, heating and air conditioning systems which pump heat from one location to another.

Background of the Invention

Since the early 1970's there has been a constant effort to improve the energy efficiency of heating and cooling units which function on the heat pump principle. As is well known, heat pumps function by relying upon the energy absorbed or released as a compressible fluid undergoes either pressure increase in a compressor or pressure decrease across a valve or other orifice. Typically, these systems rely upon phase changes from the gas to liquid state as a result of changes in pressure to effectuate heat transport. Such heat pump units are utilized for large commercial installations either for refrigeration or freezing of perishable articles and the like as well as for climate control of large commercial buildings as well as individual dwellings. The energy efficiency of these units have been greatly increased through redesigned compressors, motors and other mechanical and design improvements. Improved methods for lubricating compressors have been developed so as to reduce the frictional energy which must be overcome in the compressor while new compressor designs have also been developed in an attempt to increase the energy efficiency of the systems.

However, a need still exists for continued energy improvement in the field of heat pumps.

SUMMARY OF THE INVENTION

Accordingly, it is an object of the present invention to provide a composition which is capable of greatly increasing the energy efficiency of heat pump systems.

A further object of the present invention is to provide a composition which will be useful both in air conditioning and refrigeration units to improve their energy efficiency. A further object of the present invention is to provide a method for improving the energy efficiency of heat pump systems.

These and other objects of the present invention which will become apparent from the description which follows have been achieved by introducing into heat pump systems a composition containing a compound containing polar sites such that there are portions of the molecule which have low electron densities and other portions which have high electron densities into the system. The compound added is selected so as to remain liquid during all phases of the heat pump cycle.

DESCRIPTION OF THE PREFERRED EMBODIMENTS

Typical heat pump systems in use today rely upon a compressible fluid to transfer the heat from one location to another. The most common heat transfer media are the members of the Freon family as well as ammonia. Ammonia finds particular application in large scale refrigeration systems such as cold storage units and the like. In addition to these two classes of heat transfer media or compressible fluids, other compressible fluids may be utilized which undergo phase changes under reasonable changes of pressure. Such compressible fluids which undergo the necessary change from liquid to gaseous states by the change in pressure are well known in the art and include gases such as carbon dioxide. In general the selection of the heat transfer media is dependent upon a number of design criteria which are well known. In general, for commercial installations the use of either Freon or ammonia is most preferred. However in specially applications media such as carbon dioxide may be utilized.

The polar organic compound of the present invention contains sufficient polar groups so as to provide regions of the molecule which have high electron densities and other regions which have low electron densities. The particular compound selected must obviously be compatible with the compressible fluid being utilized as the heat transfer media and with the materials of construction of the various components of the heat transfer system. Furthermore, the compounds must remain essentially liquid under the operating conditions encountered. That is, there must be only inconsequential solidification in the cold portion or expansion section of the heat pump system and only minimal volatilization when exposed to the high temperatures on the high pressure side of the system that is, the polar compound is essentially non-compressible under operating conditions. In addition to being compatible with both the heat transfer medium and the materials of construction of the heat pump system, polar compound must also be selected to be compatible with the lubricants typically encountered in heat pump systems. As is well known, all heat pump systems contain a lubricant which is continuously circulating throughout the system to lubricate the moving parts of the compressor. Typically these lubricants are based upon naphthenic oils. The most common of the lubricants are designated 3GS and 4GS refrigeration oils. Essentially any polar compound meeting the foregoing criteria can be utilized in the practice of the present invention.

The preferred polar compounds are the liquid halogenated α-olefins and liquid halogenated paraffins; preferably the halogen is chlorine. With the most preferred group of polar compounds being liquid chlorinated α-olefins. The liquid chlorinated α-olefins are particularly preferred for refrigeration systems being utilized to store foodstuffs since α-olefins have thus far proven to be benign in tests for carcinogen activity. Hence, refrigeration systems containing liquid chlorinated α-olefins can be utilized for the storage of foodstuffs.

The liquid chlorinated α-olefins and liquid chlorinated paraffins must, remain liquid throughout the different operating phases of a heat pump system. While the molecular weight and degree of chlorination of these materials is not particularly critical, care should be taken not to use materials which contain a high wax content which may solidify in the expansion portion of the heat pump system. Such waxy materials can build up on valves and other aspects of the system causing malfunction or increase maintenance. Furthermore, the presence of these solid components may impair the achievement of the desired energy improvement. Typically, both the liquid chlorinated α-olefins and liquid chlorinated paraffins will contain from about 6 to 24 carbon atoms and from 1 to 10 or 12 chlorine atoms. The degree of chlorination and molecular weight determine the relative volatility and solidification points of the compounds. Of the chlorinated α-olefins particularly preferred is a product sold by Diamond Shamrock under the tradename Chlorowax-500AO which is a chlorinated α-olefin and has the formula of $C_{12}H_{20}Cl_6$. The preferred chlorinated liquid paraffins are sold by Diamond Shamrock under the tradename Chlorowax 5760 and Chlorowax 5960. Chlorowax 5760 has the general formula $C_{13}H_{22}Cl_6$ while 5960 has the formula $C_{12}H_{20}Cl_6$.

Other chlorinated α-olefins and paraffins can be used with the degree of chlorination being chosen simply to render the compound sufficiently polar so as to have regions of high electron density while other regions have lower electron density. High and low electron densities are relative and the degree of difference between the two regions need not be great. The key concept is to have a charge distribution in the molecule.

The polarity of the molecule is believed to result in the polar compound physically attaching itself to the metal walls of the heat pump system. The metal surfaces in the heat pump system are believed to contain a high electron charge such that the present polar molecule will orientate itself towards and form a Van der Waals bond with the metal surface. Without being bound by any particular theory, it is believed that when the polar compound binds to the metal wall that this results in a reduction in the boundary layer phenomenon which is encountered in the transfer of heat from a fluid contained within a tube through the tube wall to the surrounding fluid. This boundary layer phenomenon reduces the heat transfer coefficient thereby decreasing efficiency. From tests conducted to date, it appears that the utilization of the polar compound significantly reduces the effect of this boundary layer phenomenon. Tests thus far have demonstrated not only lower energy consumption but also substantially increased heat transfer across the heat transfer surfaces. This improved heat transfer is demonstrated by an increase in the heat transfer coefficient for the system and by shorter system cycle times. As a result of the improved heat transfer, one achieves significantly reduced power consumption in the heat pump system. Further energy savings can be achieved by taking advantage of the increased heat transfer by reducing the overall size of the heat pump system for any given load thereby resulting in further energy efficiencies from the use of smaller compressors and the like.

The amount of polar compound which must be added to the heat pump system is simply that sufficient to achieve the desired increase in energy efficiency. Generally speaking the improved energy efficiency is not achieved immediately upon addition of the polar compound to the system but requires a time delay until the polar compound has become dispersed throughout the system. The length of this delay is to an extent determined by the amount of polar compound added to the system. Accordingly, the amount of polar compound added is determined by the size of the system as well as the rate at which one desires the compound to disperse throughout the system. Typically, the amount of polar compound used is determined by the volume of lubricating oil used in the system. The percentage of polar compound will typically range from about 0.1 to about 10, preferably from 0.5 volume percent up to about 5 volume percent of the lubricating oil. More preferably, the quantity of polar compound will range from about 1% to about 2½% of the total lubricant volume. It is preferred that the polar compound be soluble in the lubricant used in the system at the volume percentage of polar compound being utilized. That is, that the solubility of the polar compound exceeds its concentration in the lubricating oil.

In addition to the other physical and chemical properties discussed previously, the polar compound should also be compatible with the lubricating oils.

The polar compound may be introduced into the heat pump system in any suitable fashion. It may be incorporated into the lubricating oil during the assembly of the system or may be added to the system during operation. If the polar compound is to be added to the system during operation it would be typically injected into the suction side of the compressor. In a particularly preferred embodiment, the polar compound is first dissolved in a carrier compound so as to form a concentrate for easy injection and for better control of the total volume to be added. Generally speaking the carrier component may be any component which is compatible with the heat pump system under question. Typically, the carrier will comprise the lubricant being utilized to lubricate the system. Still more preferably the carrier is a white oil, a naphthenic mineral oil of high purity. Such white oils are commercially available and include materials such as Texaco Capella WF and its equivalents. The utilization of white oil has the advantage of being compatible with essentially any heat pump system including both refrigeration and air conditioning. The refrigeration system is the most demanding because of the low temperatures encountered. The carrier compound must remain liquid throughout the entire heat pump cycle and should not contain substantial quantities of wax which would solidify under operating conditions. The utilization of white oil as a carrier has the advantage of allowing a single composition containing the polar compound to be utilized in essentially any heat pump system. The concentration of the polar compound in the carrier is not critical and can range from 20 to 80 volume percent and typically is approximately an equivolume mixture.

The carrier system containing an equal volume mixture of polar compound and carrier may be added to an existing oil system at a 5% rate based on the total quantity of lubricant contained in the system. The rate at which the material is added can be greater or lesser depending upon the concentration of polar compound in the carrier material and the desired final concentration of polar compound in the heat pump system.

When using halogen containing polar compounds it is preferred to use a stabilizer to prevent free halogen from forming if there is any moisture in the system. The presence of free halide can cause corrosion problems. Suitable stabilizers for chlorides are commercially available and are typically buffers which will combine with the halogen to render it benign. Such stabilizers are commercially sold by a number of companies including Diamond Shamrock's X—Chlor—XC which is a blend of chlorinated hydrocarbon with white mineral oil, wetting agents and an inhibitor. Other commercially available compounds containing halogen inhibitors can be utilized as well. The quantity of stabilizer used is not critical and can range from 0 to 20 volume percent based on polar compound preferably 0.01 to 20 volume percent, more preferably from 0.01 to 10 volume percent. The particular stabilizer selected is not critical so long as it buffers for free chloride and is compatible with the polar compound, the lubricant and remains dissolved under operating conditions.

It has been determined from testing conducted to date that the present composition and method is effective in improving the efficiency of heat pump systems both using reciprocating and rotary compressors. Substantial improvements in energy efficiency have been found in all sizes of units ranging from a 1 ton unit up to units nominally rated at 800 tons. Energy consumption improvements of greater than 10% have been achieved by the use of this invention.

EXAMPLE

The following test was performed on a York Model water-cooled, self-contained air conditioner of 3.3 ton cooling capacity, powered by a 3.0 h.p. compresser driven by a 208/220 v., 3-phase, 60-hertz electric motor during incremental treatment with Chlorowax 500AO. These tests were conducted in a teaching laboratory of approximately 7200 cubic feet.

1. Equipment selection:

A well-used hermetically sealed compressor with the manufacturer's original condenser, expansion valve, evaporator, and attendant Freon R-22 control system was intentionally chosen for this investigation. The unit tested was purchased and initially used in 1962, and contained 0.875 gal. of York "C" oil as the hermetically sealed lubricant. A comparison of the manufacturer's ratings for the system to those measured during this test are shown below:

| | Original Rating (1962) | Current Measurement (1987) |
|---|---|---|
| Amps per phase | 10.0 | 8.7, 7.9, 8.2 |
| Watts | 2980 | 2780 |
| Power factor | ? | 0.83–0.85 |
| Air flow: | | |
| Cu. ft./min. | 1200 | 1150 ± 50 |
| dry bulb, F. | 80 | 79 |
| rel. humidity | 50 | 65 |
| Condenser | clean | clean |
| cooling water, F. | 95 | 95 |
| Variation in watts and amps under these air conditions | 10% (expected) | 1.0% (measured) |

2. Motor monitoring:

The monitoring equipment consisted of an Esterline-Angus S-22904 Mini Servo III Power Survey unit with a 3-pen capacity for continuous recording of KVA demand, KW, and reactive KVA (or KVAR), and with read-out capability for instantaneous KVA and power factor. Additionally, a resettable counter indicated cumulative KWH consummation whenever the motor was energized. Clamp-on current transformers were used to reduce full line amperage of each of the three motor phases by a factor of 100 during transmission to the recording watt meter.

3. Addition of Chlorowax-500 AO

Injection of the Chlorowax liquid into the hermetically sealed lubrication oil system was accomplished by installing pneumatic check valves in the high-pressure liquid Freon line from the compresser and in the low-pressure Freon vapor line leading to the suction port of the compresser. While the compresser is running, these valves were used to withdraw a small amount of high-pressure Freon into a copper cartridge which contained 15 ml. of liquid Chlorowax. The pressurized cartridge was then isolated from the high-pressure side of the compresser, following which the contents of the cartridge were vented by a suitable needle valve arrangement into the low-pressure Freon vapor line to become entrained in the refrigerant flow to the suction port of the compresser. The 15 ml. volume was selected as the aliquot of the 180 ml. total addition ultimately required to adjust the lubrication system to approximately 5% Chlorowax and 95% oil (by volume). The 15 ml. aliquots were then added in a total of 12 periodic injections over the course of the study.

4. Cooling load:

The cooling load presented to the air conditioning unit was dependent upon the outdoor ambient temperature. The room to be cooled was separated from the normal temperature control system of the building.

The prevailing building temperatures during the test period ranged from 77 F to 84 F dry bulb (db) and 69 F to 74 F wet bulb (wb) as measured in various portions of the corridor, adjoining laboratories, and laboratories immediately above and below the Room. The air conditioner thermostat in the Room was set at 71 F throughout the test, and this setting maintained the room at 70–71 F. (db) and 64–65 F. (wb) during all measuring periods.

A period at a thermostat setting of 73 F. was also evaluated for calibration purposes after an extensive study of the effect of the 2.5% Chlorowax/97.5% oil (by volume) ratio on the cooling performance of the unit had been made.

Under these conditions, the modified York 354 unit was required to remove the net heat gain experienced by the test room. Heat transmission through the exterior wall (and fenestration) provided a varying natural heat loss from the room when outdoor temperatures were below 71 F., but added to the heat gain of the room at higher outdoor temperatures. Since this component of the heat load to the test room varies with the ambient temperatures over the 24-hour day, the performance of the air conditioning unit consumed energy in a similar pattern. Thus, the test system was "tuned" to the sun and prevailing weather conditions.

Results:

Tabulated below is a summary of the daily energy consumption of the compressor motor for the corresponding cooling degree hours confronting the air conditioning unit. These data were developed following the injection of Chlorowax at each of the following dates:

| Chlorowax 15 ml. add'ns Injection No. | Date in 1987 | Days elapsed between injections | Days evaluated after injection | Comments |
|---|---|---|---|---|
| 1 | 03/06 | — | 0 | Trial of injection procedure |
| 2 | 03/06 | 0 | 2 | Chart paper problems |
| 3 | 03/09 | 3 | 1 | Chart paper problems |
| 4 | 03/12 | 3 | 1 | System in control |
| 5 | 03/13 | 1 | 2 | Change in building environment program |
| 6 | 03/16 | 3 | 24 | Cold spells, fan motor failures, and cooling water interruptions |
| 7 | 05/01 | 46 | 3 | Continuous oper- |

-continued

| Chlorowax 15 ml. add'ns Injection No. | Date in 1987 | Days elapsed between injections | Days evaluated after injection | Comments |
|---|---|---|---|---|
| | | | | ation with system in control |
| 8 | 05/04 | 3 | 5 | Continuous operation with system in control |
| 9 | 05/09 | 5 | 3 | Continuous operation with system in control |
| 10 | 05/12 | 3 | 3 | Continuous operation with system in control |
| 11 | 05/15 | 3 | 6 | Continuous operation with system in control |
| 12 | 05/21 | 6 | 4 | Continuous operation with system in control |
| Test terminated | 05/28 | — | — | Continuous operation with system in control |
| Totals | 83 calendar | 76 | 54 | 28 calendar days unsuitable for evaluation |

TABLE I

Performance of York 354 Air Conditioner Unit at Various Concentrations of Chlorowax

| Chlorowax concentration | | | Degree hours | Compresser motor KWH | Temperature, F. | |
|---|---|---|---|---|---|---|
| | | | | | maximum | minimum |
| ml. | Approx. % by vol. | Days after last injection | Midnight-to-midnight 24-hr. period | | | |
| 90 | 2.5 | 3 | 32 | 44.83 | 71 | 48 |
| | | 5 | 100 | 43.55 | 81 | 44 |
| | | 6 | 129 | 35.71 | 82 | 47 |
| | | 7 | 127 | 32.70 | 79 | 50 |
| | | 8 | 38 | 26.66 | 75 | 52 |
| | | 9 | 59 | 29.36 | 75 | 44 |
| | | 10 | 75 | 25.30 | 78 | 46 |
| | | 11 | 67 | 25.76 | 75 | 49 |
| | | 12 | 120 | 41.04 | 81 | 43 |
| | | 13 | 79 | 27.93 | 79 | 43 |
| | | 24 | 102 | 25.43 | 79 | 44 |
| | | 25 | 111 | 31.00 | 80 | 43 |
| 105 | 3.0 | 1 | 239 | 34.13 | 91 | 58 |
| | | 2 | 175 | 30.48 | 87 | 59 |
| | | 3 | 134 | 25.02 | 81 | 64 |
| 120 | 3.4 | 0 | 186 | 28.47 | 85 | 60 |
| | | 1 | 170 | 27.98 | 83 | 63 |
| | | 2 | 145 | 26.88 | 80 | 62 |
| | | 3 | 97 | 21.65 | 78 | 63 |
| | | 4 | 178 | 22.01 | 83 | 59 |
| 135 | 3.9 | 0 | 199 | 123.02 | 84 | 51 |
| | | 1 | 60 | 17.63 | 74 | 62 |
| | | 2 | 126 | 21.27 | 82 | 61 |
| 150 | 4.3 | 0 | 148 | 23.00 | 81 | 63 |
| | | 1 | 166 | 27.79 | 84 | 61 |
| | | 2 | 166 | 24.66 | 84 | 66 |
| 165 | 4.7 | 0 | 192 | 24.36 | 84 | 66 |
| | | 1 | 227 | 27.86 | 85 | 66 |
| | | 2 | 195 | 21.99 | 85 | 66 |
| | | 3 | 171 | 22.61 | 78 | 69 |
| | | 4 | 273 | 29.83 | 86 | 68 |
| | | 5 | 331 | 32.92 | 89 | 69 |
| 180 | 5.1 | 2 | 295 | 32.85 | 88 | 69 |
| | | 3 | 317 | 33.60 | 90 | 66 |
| | | 6 | 291 | 33.79 | 90 | 65 |

Daily values shown in Table I for degree hours and KWH consumed by the compresser motor were measured from midnight-to-midnight central standard time. The day-to-day variations in KWH is a result of variation in the total cycle time over 24-hours rather than an observed change in line current or wattage during these periods when the motor was energized (by thermostat signal). The power to the motor remained essentially constant at 2.79 KW. Throughout the test, the thermostat was locked at the 71 F setting. These tests reveal an optimum concentration of 4.7 volume percent for the Chlorowax.

Obviously, numerous modifications and variations of the present invention are possible in light of the above teachings. It is therefore to be understood that within the scope of the appended claims, the invention may be practiced otherwise than as specifically described herein.

What is claimed is:

1. A method of improving the efficiency of a heat pump system comprising introducing into the system a polar compound comprising a chlorinated α-olefin or a chlorinated paraffin, wherein said polar compound is liquid under said systems operating conditions.

2. In a heat pump system containing a compressible fluid, the improvement comprising a polar compound added to the compressible fluid, wherein said polar compound comprises a chlorinated α-olefin or a chlorinated paraffin which remains liquid throughout the heat pump system in an amount sufficient to improve the energy efficiency of the system.

3. An additive for heat pump systems comprising a polar compound and a carrier fluid, wherein said polar compound is a chlorinated α-olefin or a chlorinated paraffin.

4. The method of claim 1, wherein said polar compound is a chlorinated hydrocarbon containing 6–24 carbon atoms and 1 to 12 halogen atoms.

5. The method of claim 1, wherein said polar compound has the formula $C_{12}H_{20}Cl_6$.

6. The method of claim 1, wherein said heat pump system contains a lubricant and said polar compound is present in an amount of from 0.1 to 10 volume percent based on the volume of lubricant.

7. The additive of claim 3, wherein the carrier is white oil.

8. The additive of claim 3, wherein the polar compound is a liquid chlorinated $\alpha$-olefin of the formula $C_{12}H_{20}Cl_6$.

9. The additive of claim 8, wherein a buffer is present.

10. The additive of claim 3, wherein the carrier is a naphthenic oil.

* * * * *